US008789613B2

(12) United States Patent
Harms

(10) Patent No.: US 8,789,613 B2
(45) Date of Patent: Jul. 29, 2014

(54) APPARATUS AND METHODS FOR RETRIEVING A WELL PACKER

(71) Applicant: Halliburton Energy Services, Inc., Houston, TX (US)

(72) Inventor: Timothy E. Harms, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/085,604

(22) Filed: Nov. 20, 2013

(65) Prior Publication Data

US 2014/0166306 A1 Jun. 19, 2014

Related U.S. Application Data

(63) Continuation of application No. PCT/US2012/070226, filed on Dec. 18, 2012.

(51) Int. Cl.
*E21B 33/12* (2006.01)
*E21B 33/129* (2006.01)

(52) U.S. Cl.
CPC ..... *E21B 33/129* (2013.01); *E21B 33/12* (2013.01)
USPC ..... 166/387; 166/179

(58) Field of Classification Search
CPC ..... E21B 23/00; E21B 23/01; E21B 23/06; E21B 33/12; E21B 33/1293
USPC ..... 166/377, 387, 179, 123, 134, 138, 217
See application file for complete search history.

(56) References Cited

U.S. PATENT DOCUMENTS 5,333,685 A 8/1994 Gilbert
6,581,681 B1 6/2003 Zimmerman et al.

(Continued)

OTHER PUBLICATIONS

Halliburton; "Biased Closed Body Lock Rings—Requirements and Procedures for 110 KSI Low Alloy Steel", Engineering Specification—Manufacturing Procedure, received Nov. 21, 2013, 6 pages.

(Continued)

*Primary Examiner* — Daniel P Stephenson
(74) *Attorney, Agent, or Firm* — Smith IP Services, P.C.

(57) ABSTRACT

A method of releasing a well packer can include applying a predetermined tension in a tubular string connected to the packer, and then reducing the tension, thereby retracting inward at least one slip of the packer. A well packer can include a generally tubular mandrel, at least one slip configured for gripping a well surface, the slip being extendable outward by engagement with a support surface, and a gripping device which permits displacement of the mandrel relative to the support surface in one direction, and which prevents displacement of the mandrel relative to the support surface in an opposite direction. A method of manufacturing a gripping device can include deforming a sleeve, thereby changing a diameter of the sleeve, aligning teeth on the sleeve across at least one slot in the sleeve, and heat treating the sleeve while the sleeve remains deformed and the teeth remain aligned.

8 Claims, 8 Drawing Sheets

(56) References Cited

U.S. PATENT DOCUMENTS

| | | | | |
|---|---|---|---|---|
| 8,002,045 | B2 | 8/2011 | Ezell et al. | |
| 8,240,390 | B2 | 8/2012 | Hendrickson et al. | |
| 2005/0077053 | A1* | 4/2005 | Walker et al. | 166/387 |
| 2005/0224226 | A1* | 10/2005 | Read, Jr. | 166/217 |
| 2009/0065192 | A1* | 3/2009 | Lucas | 166/119 |
| 2009/0242213 | A1 | 10/2009 | Braddick | |
| 2009/0273201 | A1 | 11/2009 | Slack | |
| 2011/0132594 | A1 | 6/2011 | Slack | |
| 2011/0284208 | A1 | 11/2011 | Macleod et al. | |
| 2012/0111556 | A1 | 5/2012 | Palmer et al. | |
| 2012/0160522 | A1* | 6/2012 | Burgos | 166/387 |
| 2012/0285684 | A1 | 11/2012 | Crow et al. | |

OTHER PUBLICATIONS

Halliburton; "JAXX Thread Profile for High Load-Bearing Snap Rings", D00055803, Jul. 28, 2002, 4 pages.

Halliburton; "Lock Ring Design Principles and Guidelines", Mechanical Downhole TEG Design Standard, dated Oct. 22, 2009, 12 pages.

Halliburton; "Otis Slimline Buttress Threads", Mechanical Downhole TEG Design Standard, dated Nov. 9, 2006, 12 pages.

Search Report and Written Opinion issued Aug. 27, 2013 for international application PCT/US12/70226, 13 pages.

Office Action issued Feb. 14, 2014 for U.S. Appl. No. 14/147,520, 10 pages.

* cited by examiner

APPARATUS AND METHODS FOR RETRIEVING A WELL PACKER

CROSS-REFERENCE TO RELATED APPLICATION

This application is a continuation under 35 USC 120 of International Application No. PCT/US12/70226, filed on 18 Dec. 2012. The entire disclosure of this prior application is incorporated herein by this reference.

BACKGROUND

This disclosure relates generally to equipment utilized and operations performed in conjunction with a subterranean well and, in an example described below, more particularly provides apparatus and methods for retrieving a well packer.

Packers are typically used in wells to seal off annular spaces between tubular strings (such as, tubing and casing or liner strings, etc.), or between a tubular string and a wellbore wall. It is beneficial at times to be able to retrieve a packer after it has been set (e.g., operatively installed) in a well. It will be appreciated that improvements are continually needed in the arts of constructing and operating packers, so that such packers are conveniently retrievable.

DETAILED DESCRIPTION

Figure 1:
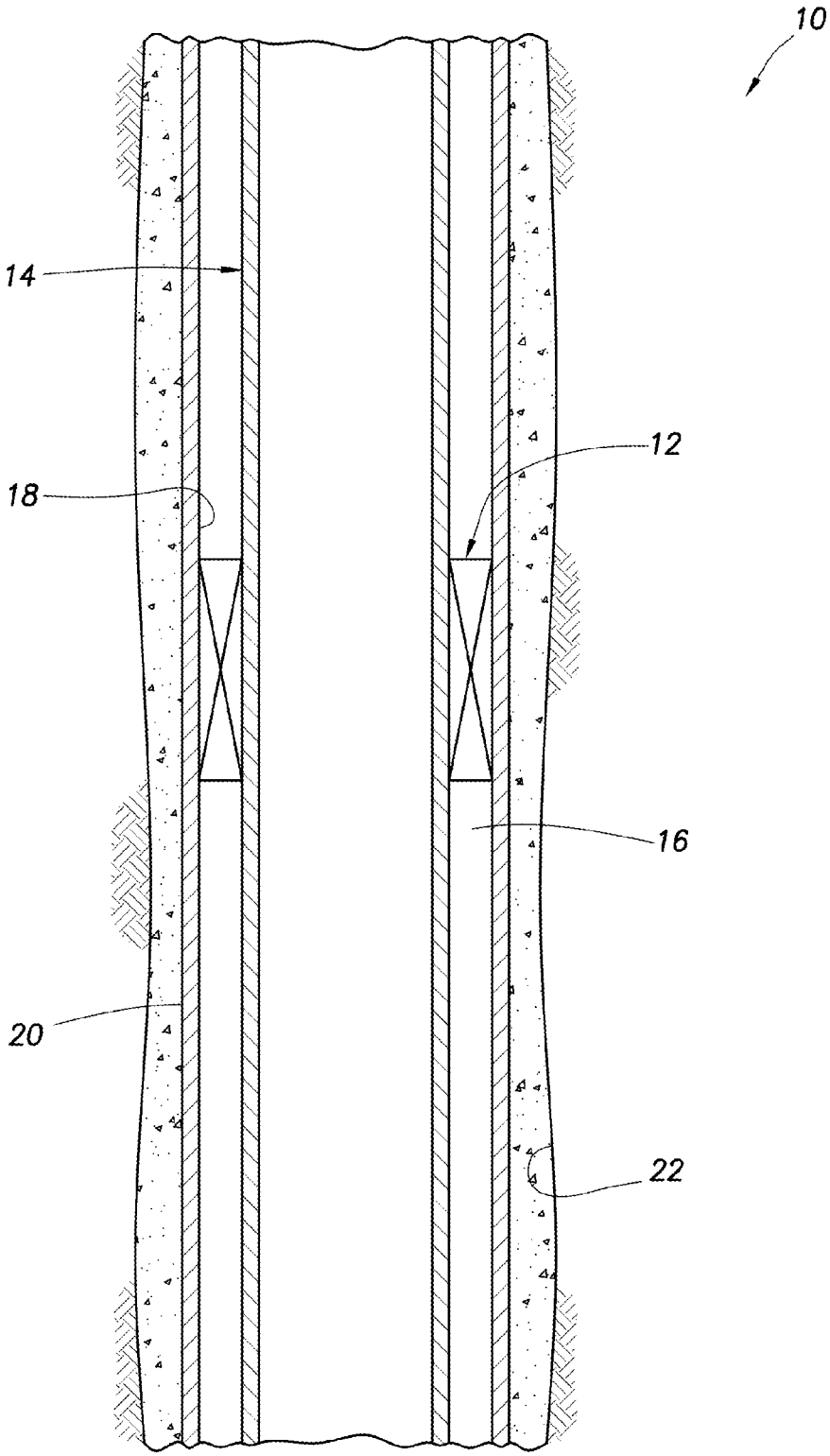
FIG. 1 is a representative partially cross-sectional view of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well packer 12 is connected in a tubular string 14 positioned in a well. The packer 12 is set as depicted in FIG. 1, so that the packer seals off an annulus 16 between the tubular string 14 and an external generally cylindrical well surface 18.

The well surface 18 in the FIG. 1 example comprises an inner surface of a liner or casing 20 cemented in a wellbore 22. In other examples, the well surface 18 could comprise a wall of the wellbore 22 (e.g., if the wellbore is uncased or open hole). The scope of this disclosure is not limited to the packer 12 sealing against any particular surface in a well.

The packer 12 also grips between the tubular string 14 and the well surface 18, so that the tubular string is anchored in the well. For this purpose and others, the packer 12 includes slips which grip by pressing teeth into the well surface 18. However, in other examples, other types of slips, or other types of gripping devices, could be used.

Although in FIG. 1 the wellbore 22 is depicted as being generally vertical, in other examples, the wellbore could be generally horizontal or deviated. For convenience, directions in the below description are referenced to the FIG. 1 vertical orientation, but it should be clearly understood that the scope of this disclosure is not limited to any particular directions described herein.

Figure 2A:
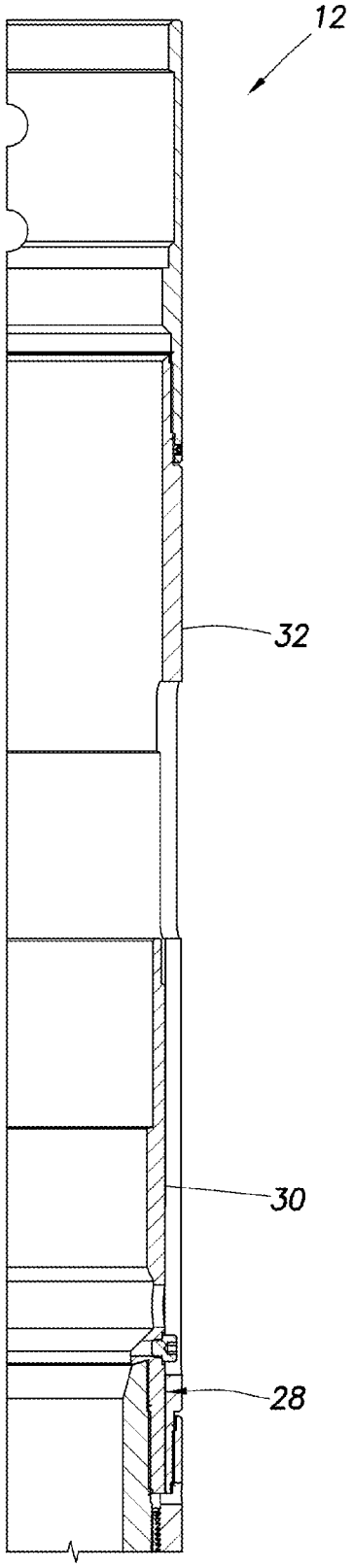
FIGS. 2A-C are representative cross-sectional views of longitudinal sections of a well packer which can embody the principles of this disclosure, the well packer being in a run-in configuration.
Figure 2B:
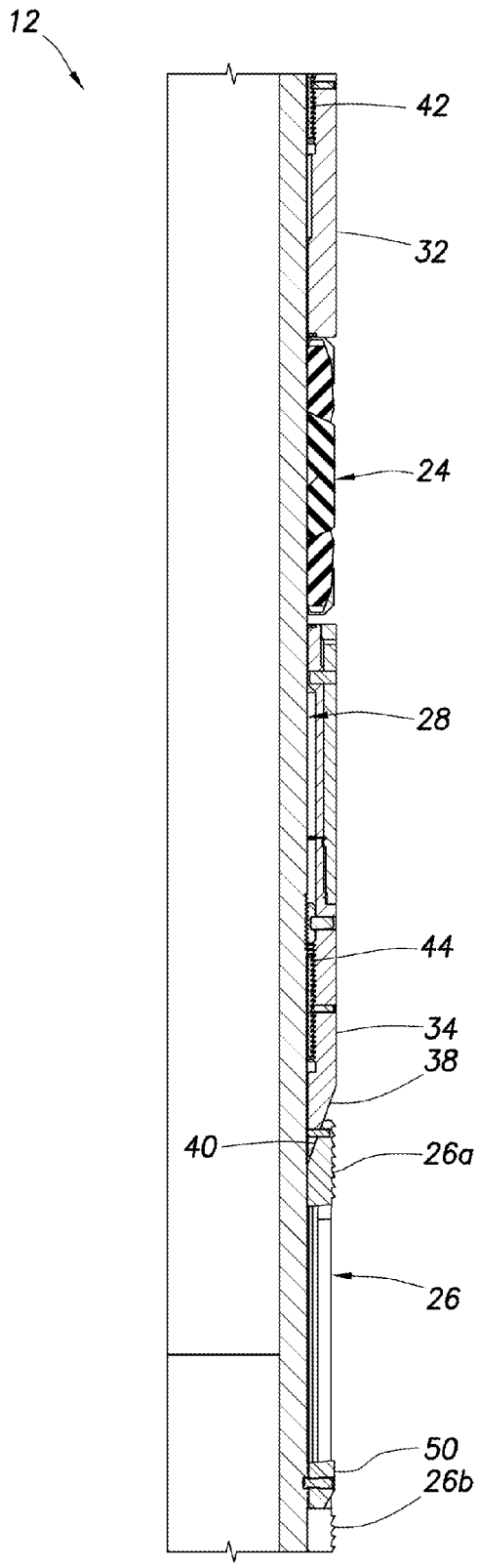
Figure 2C:
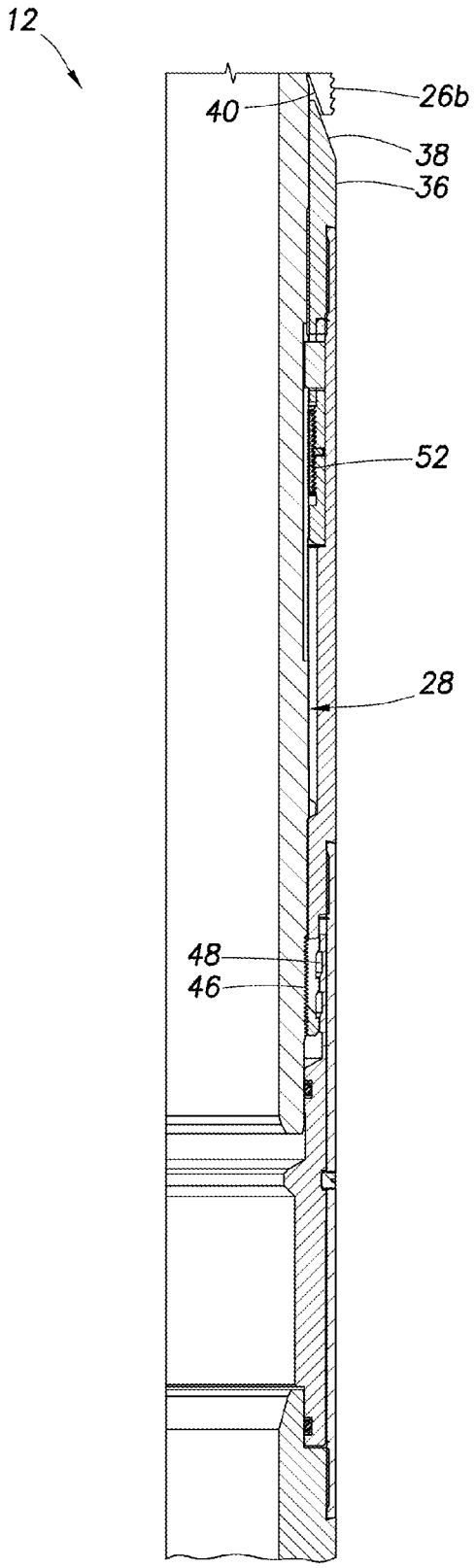

Referring additionally now to FIGS. 2A-C, an example of the well packer 12 is representatively illustrated in cross-sectional views of successive longitudinal sections. The packer 12 is depicted in a run-in configuration in FIGS. 2A-C, prior to outwardly extending a seal element assembly 24 and one or more slips 26 into engagement with the well surface 18.

The seal element assembly 24 and slips 26 are carried on an inner generally tubular mandrel 28. The mandrel 28 has an upper tubular string connector 30 for connecting to the tubular string 14.

When it is desired to set the packer 12, an outer setting sleeve 32 is displaced downwardly (as viewed in FIGS. 2A-C) relative to the mandrel 28. A conventional setting tool (not shown) may be used for this purpose.

Figure 3A:
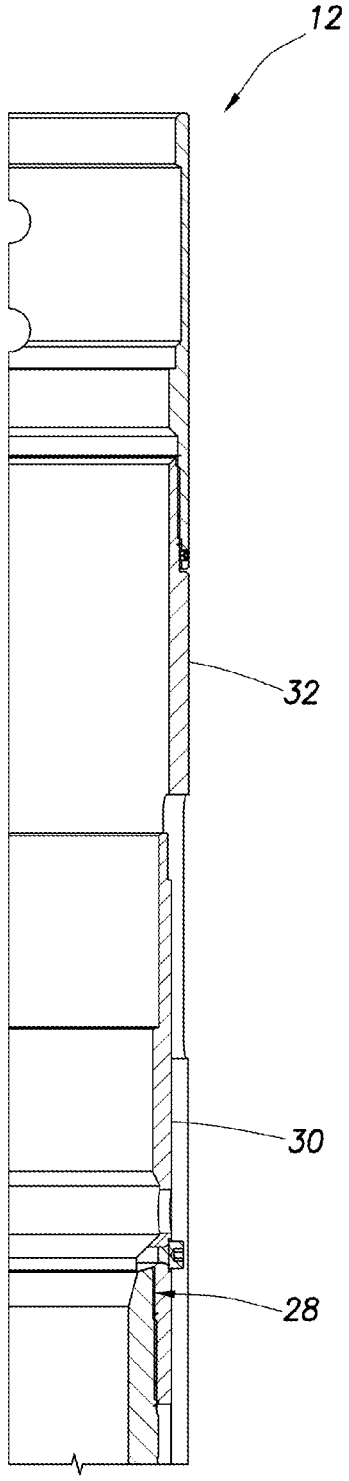
FIGS. 3A-C are representative cross-sectional views of the well packer in a set configuration.
Figure 3B:
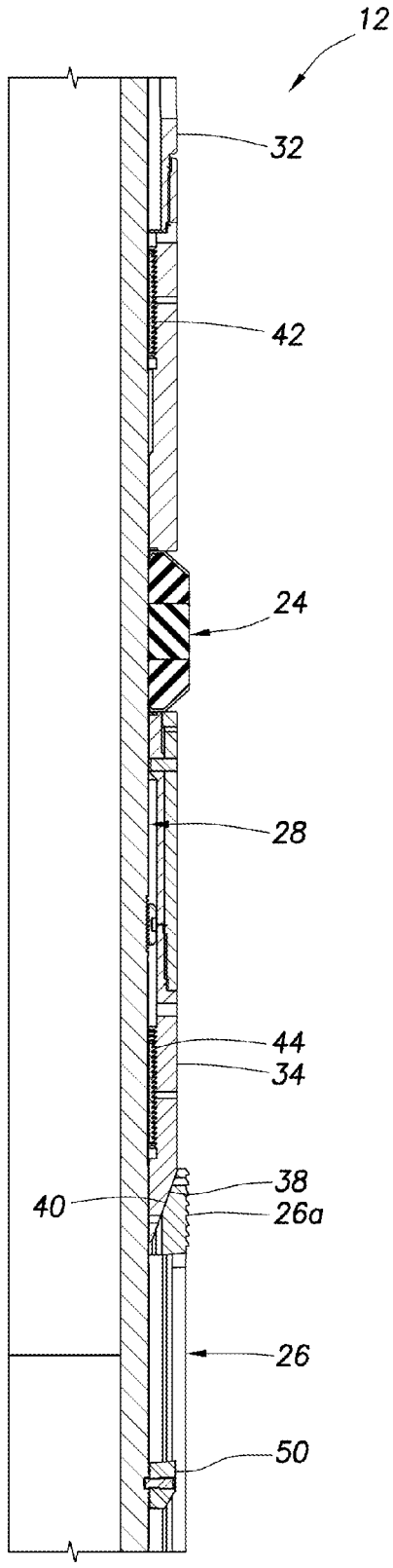
Figure 3C:
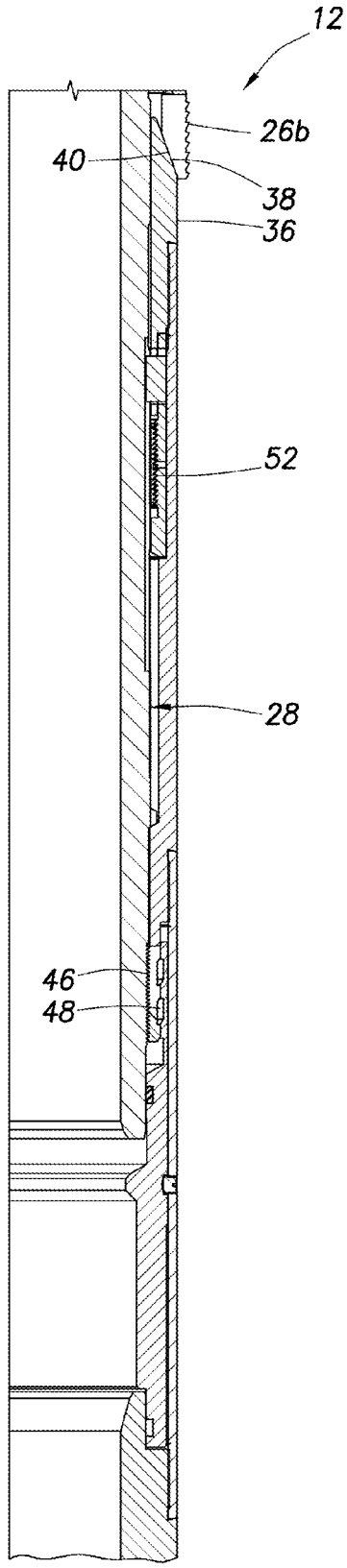

Such downward displacement of the setting sleeve 32 relative to the mandrel 28 causes the seal element assembly 24 to be longitudinally compressed and outwardly extended into sealing engagement with the well surface 18, and causes the slips 26 to extend outwardly into gripping engagement with the well surface. This set configuration of the packer 12 is representatively illustrated in FIGS. 3A-C.

Note that the slips 26 are extended outwardly by downwardly displacing an upper wedge 34 toward a lower wedge 36. Each of the wedges 34, 36 has an inclined frusto-conical support surface 38 which engages an inner inclined surface 40 in the slips 26. The slips 26 are displaced outward by the downward displacement of the upper wedge 34, and by the complementary engagement of the surfaces 38, 40.

An upper gripping device 42 maintains compression in the seal element assembly 24 after the setting sleeve 32 has been downwardly displaced, by preventing subsequent upward displacement of the setting sleeve. Another gripping device 44 maintains the slips 26 in their outwardly extended position by preventing upward displacement of the upper wedge 34 relative to the mandrel 28.

In the FIGS. 2A-3C example, the gripping devices 42, 44 comprise elements known to those skilled in the art as "body lock rings." Such body lock rings may comprise internally and externally toothed (e.g., threaded) resilient sleeves which can grip to prevent relative displacement between elements in one direction, but can permit relative displacement between the elements in an opposite direction.

Figure 4:
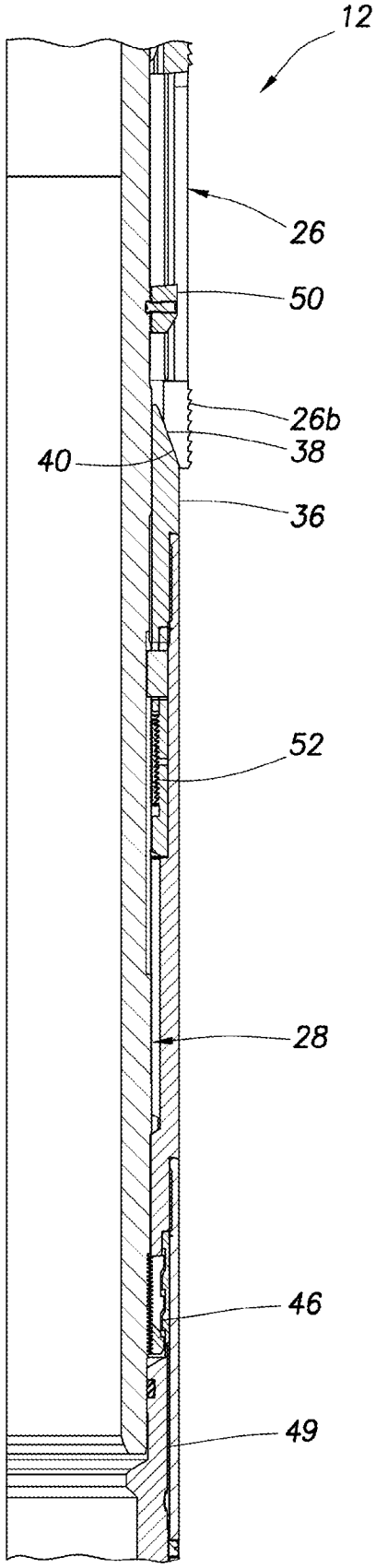
FIG. 4 is a representative cross-sectional view of a section of the well packer with a retrieval operation initiated.
Figure 5:
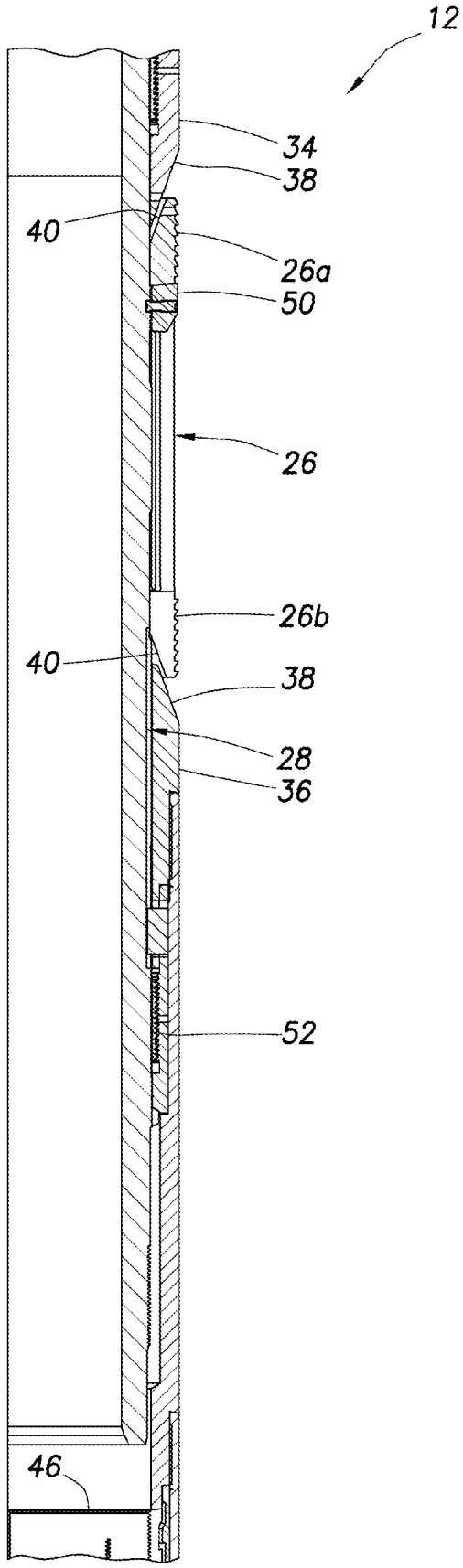
FIG. 5 is a representative cross-sectional view of the well packer section during retrieval.

Referring additionally now to FIGS. 4 & 5, a retrieval operation is representatively illustrated. In this operation, a shiftable sleeve 49 is displaced upwardly (e.g., by using a wireline or coiled tubing-conveyed shifting tool) until a gripping ring 46 is permitted to expand outward into a complementarily shaped profile 48 in the sleeve 49, as depicted in FIG. 4. When the ring 46 expands, the mandrel 28 is released for upward displacement relative to the slips 26 and lower wedge 36, as depicted in FIG. 5.

A pickup shoulder 50 carried on the mandrel 28 will engage an upper portion 26*a* of the slips 26, thereby pulling the slips upward with the mandrel. However, in some circumstances, this retrieval operation can be unsuccessful if the slips 26 cannot be disengaged from the well surface 18. One such circumstance can occur when the tubular string 14 is in compression below the packer 12 after the packer is set.

This compression in the tubular string 14 below the packer 12 can continuously bias the lower wedge 36 upward, so that a lower portion 26*b* of the slips 26 is biased outward into gripping engagement with the well surface 18. In such situations (and others), a contingency retrieval operation can be performed, in order to downwardly displace the lower wedge 36 relative to the slips 26, so that the support surface 38 no longer outwardly biases the lower portion 26*b* of the slips.

Figure 6:
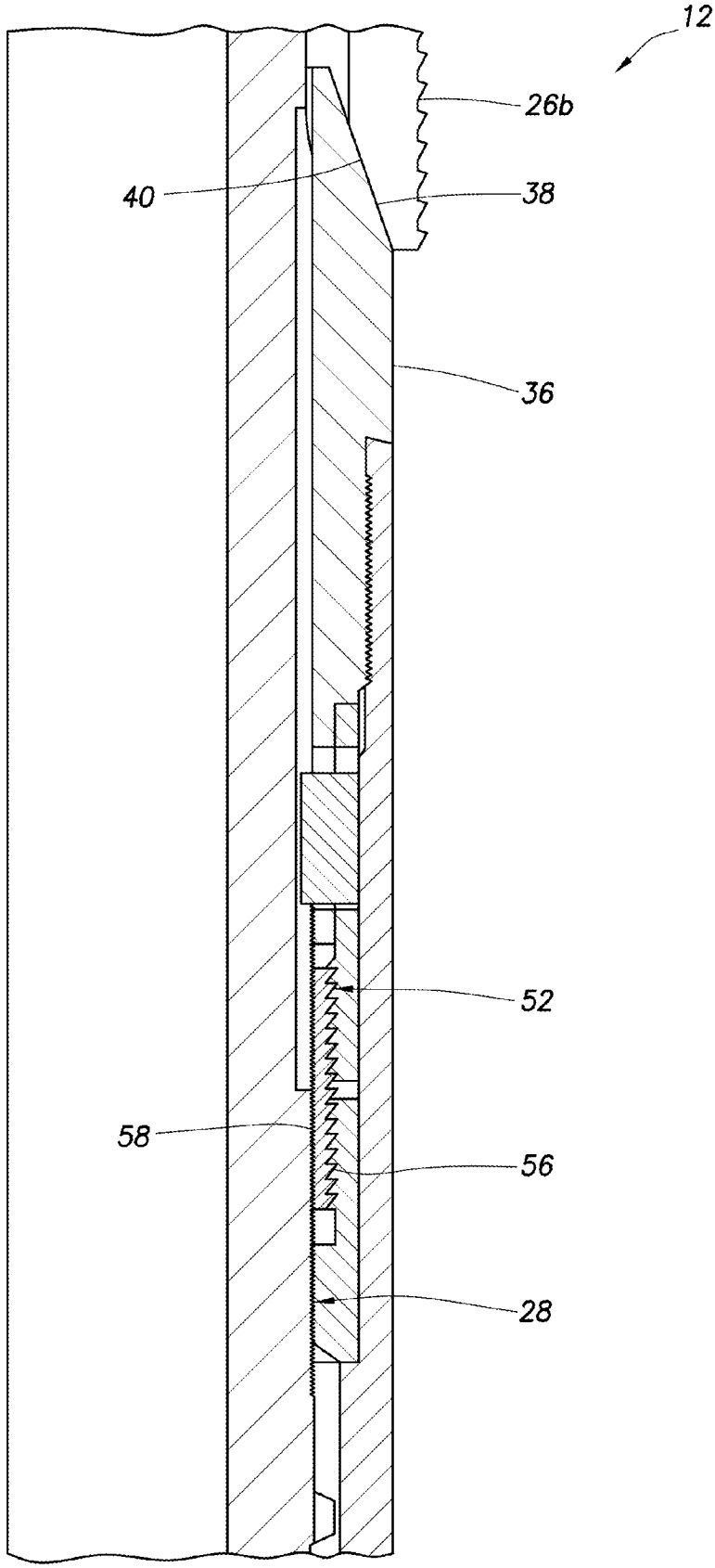
FIG. 6 is a representative cross-sectional view of another section of the packer with a contingency retrieval operation initiated.

Referring additionally now to FIG. 6, the contingency retrieval operation is representatively illustrated. The contingency retrieval operation makes use of another gripping device 52, which permits upward displacement of the mandrel 28 relative to the lower wedge 36, but which prevents downward displacement of the mandrel relative to the lower wedge.

As viewed in FIG. 6, the mandrel 28 has been displaced upward relative to the lower wedge 36, for example, by applying a predetermined amount of tension in the tubular string 14 above the packer 12. The support surface 38 on the lower wedge 36 remains engaged with the inner surface 40 in the lower slip portion 26*b*, and so the slips 26 remain grippingly engaged with the well surface 18 when the mandrel 28 is upwardly displaced. As mentioned above, the gripping device 52 permits this upward displacement of the mandrel 28 relative to the lower wedge 36.

The mandrel 28 can then be displaced downwardly, for example, by slacking off on the tubular string 14 above the packer 12. The tubular string 14 may be placed in compression at the packer 12, due to this slacking off. When the mandrel 28 displaces downwardly, the lower wedge 36 will also displace downwardly with the mandrel, since the gripping device 52 prevents downward displacement of the mandrel relative to the lower wedge.

When the lower wedge 36 displaces downwardly with the mandrel 28, the support surface 38 will no longer outwardly support the slips 26 in gripping engagement with the well surface 18, and the packer 12 can then be retrieved, or at least repositioned in the well.

Figure 7:
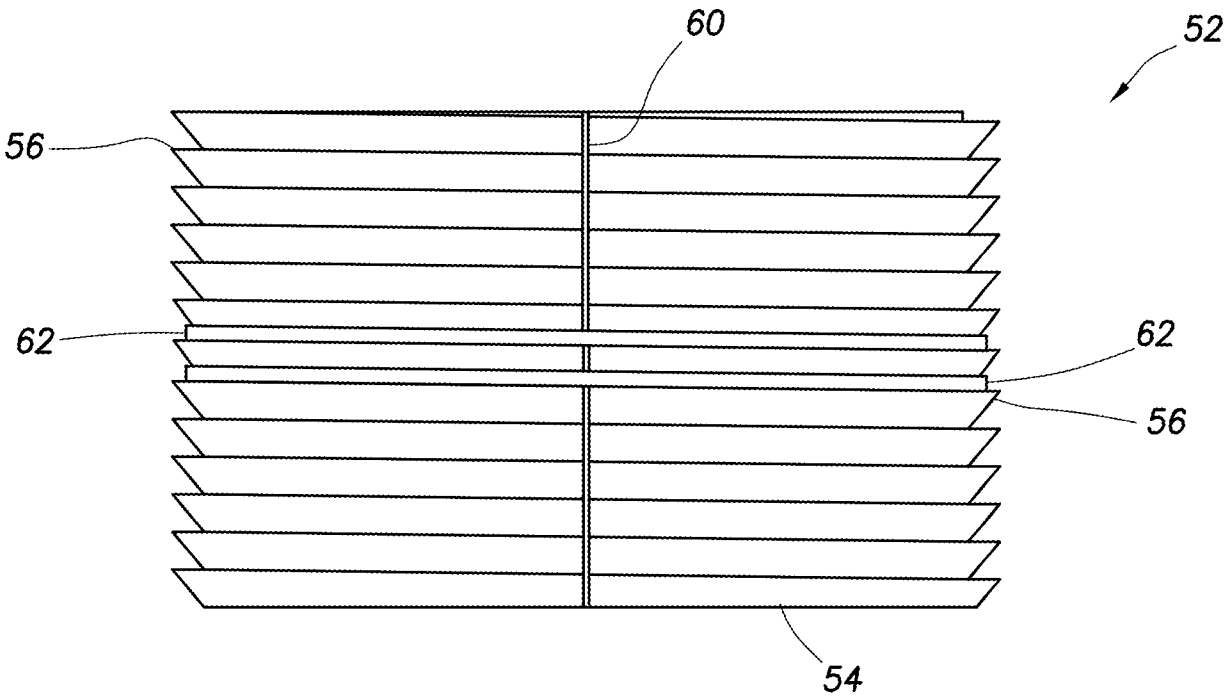
FIG. 7 is a representative side view of a gripping device which may be used in the packer.

An example of the gripping device 52 is representatively illustrated apart from the remainder of the packer 12 in FIG. 7. In this view, it may be seen that the gripping device 52 comprises a generally cylindrical sleeve 54 having circumferentially extending teeth 56 formed externally thereon.

Internal teeth 58 are also formed in the sleeve 54, but are not visible in FIG. 7 (see, e.g., FIG. 6). The internal teeth 58 grip an outer surface of the mandrel 28 to prevent downward displacement of the mandrel relative to the gripping device 52.

In this example, the teeth 56, 58 are in the form of threads which extend helically on the sleeve 54. In other examples, the teeth 56, 58 could extend circumferentially on the sleeve without also extending helically, in which case the teeth would not be in the form of threads.

In one example of a method for manufacturing the gripping device 52, the sleeve 54 is machined with the external and internal teeth 56, 58 formed thereon prior to cutting a longitudinal slot 60 though the sleeve. The slot 60 allows the sleeve 54 to be resiliently compressed and expanded radially.

When the teeth 56, 58 are formed on the sleeve 54, the teeth are formed with their corresponding pitch diameters at an operative position of the teeth. The teeth 58 are at their operative positions when they are engaged with the outer surface of the mandrel 28, which may have complementarily shaped teeth formed thereon. Thus, the sleeve 54 is formed with the teeth 56, 58 thereon at pitch diameters corresponding to their operative positions.

The slot 60 is then cut through the sleeve 54, allowing the sleeve to be radially deformed. After cutting the slot 60, the sleeve 54 is radially compressed, as depicted in FIG. 7.

The sleeve 54 is heat treated in this compressed configuration. Preferably, a QPQ (quench-polish-quench) liquid salt bath process heat treatment is used to improve anti-galling properties and wear resistance of the gripping device 52, but other types of heat treatment may be used, if desired.

After the heat treatment, the sleeve 54 retains its compressed configuration, without clamping. Thus, in order to install the gripping device 52 on the mandrel 28, the slot 60 is pried open (or the sleeve is otherwise radially enlarged), the sleeve 54 is positioned on the mandrel, and then the sleeve is allowed to resiliently grip the outer surface of the mandrel.

Note that, when installed on the mandrel 28, the internal teeth 58 are again at their operative positions, substantially conforming to their original pitch diameters. This provides for full operative engagement between the internal teeth 58 on the sleeve 54 and the teeth on the outer surface of the mandrel 28, ensuring maximum load carrying capability.

The teeth 56, 58 may be maintained in alignment during the heat treatment process by using one or more alignment devices 62 which engage the teeth on opposite sides of the slot 60. For example, a resilient helical ring having any number of full or partial wraps about the sleeve 54 could be used as an alignment device 62. Of course, if the teeth 56, 58 are not formed as helical threads, then the alignment device 62 may not be helical in form, either.

In some examples, the alignment device 62 could also be used for maintaining a deformed configuration of the sleeve 54 during the heat treatment process. Note that, for different applications, the sleeve 54 could be deformed outwardly or inwardly during the heat treatment process.

Although in the above method, the external teeth 56 are engaged with the alignment device 62, it will be appreciated that in other examples the alignment device (or another alignment device) could be engaged with the internal teeth 58.

It may now be fully appreciated that the above disclosure provides significant advancements to the art of constructing and operating well packers. In one example described above, the packer 12 can be conveniently released from gripping engagement with a well surface 18 by applying a tensile load to the packer (or to a tubular string connected to the packer), and then releasing the tensile load.

A method of releasing a packer 12 set in a well is provided to the art by the above disclosure. In one example, the method can comprise: applying a predetermined level of tension in a tubular string 14 connected to the packer 12 (for example, by picking up on the tubular string at the surface); and then reducing the level of tension in the tubular string 14 (for example, by slacking off on the tubular string at the surface), thereby retracting inward at least one slip 26 of the packer 12.

The applying step can include displacing an inner generally tubular mandrel 28 of the packer 12 in an upward direction relative to a support surface 38 which outwardly supports the slip 26.

The reducing step can include displacing the mandrel 28 and the support surface 38 in a downward direction opposite to the upward direction.

The step of displacing the mandrel 28 and the support surface 38 in the second direction can include a gripping device 52 preventing displacement of the mandrel 28 in the downward direction relative to the support surface 38.

The step of displacing the mandrel 28 in the upward direction can include the gripping device 52 permitting the displacement of the mandrel 28 relative to the support surface 38.

The reducing step can include applying compression in the tubular string 14 adjacent the packer 12.

The reducing step can include displacing a support surface 38 which outwardly supports the slip 26.

A well packer 12 is also described above. In one example, the packer 12 can include a generally tubular mandrel 28, at least one slip 26 configured for gripping a well surface 18, the slip 26 being extendable outward by engagement with a support surface 38, and a gripping device 52 which permits displacement of the mandrel 28 relative to the support surface 38 in a first direction, and which prevents displacement of the mandrel 28 relative to the support surface 38 in a second direction opposite to the first direction.

The gripping device 52 can comprise a resilient toothed sleeve 54 which grips the mandrel 28. The gripping device 52 is preferably connected to the support surface 38.

The support surface 38 can comprise a frusto-conical surface which engages an inclined surface 40 of the slip 26.

The slip 26 may be inwardly retractable in response to displacement of the mandrel 28 and support surface 38 in the second direction relative to the slip 26.

The gripping device 52 can include inner teeth 58 which in an operative position thereof operatively engage the mandrel 28, the inner teeth 58 conforming substantially to a pitch diameter of the inner teeth 58 at the operative position. The gripping device 52 may resiliently grip the mandrel 28 when the inner teeth 58 are at the operative position.

A method of manufacturing a gripping device 52 is also described above. In one example, the method can comprise: deforming a sleeve 54, thereby changing a diameter of the sleeve 54; aligning teeth 56, 58 on the sleeve 54 across at least one slot 60 in the sleeve 54; and heat treating the sleeve 54 while the sleeve remains deformed and the teeth 56, 58 remain aligned.

The method can include cutting the slot 60 in the sleeve 54 prior to the deforming.

The method can include forming the teeth 56, 58 on the sleeve 54 prior to the deforming.

The forming step can include the teeth 58 conforming substantially to a pitch diameter of the teeth 58 at an operative position thereof.

The aligning step can include positioning an alignment device 62 across the slot 60 and in engagement with the teeth 56, 58 on opposite sides of the slot 60.

The changing step can include reducing the diameter of the sleeve 54.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of releasing a packer set in a well, the method comprising:

applying a predetermined level of tension in a tubular string connected to the packer; and then reducing the level of tension in the tubular string, thereby retracting inward at least one slip of the packer, wherein the applying further comprises displacing an inner generally tubular mandrel of the packer in a first direction relative to a support surface which outwardly supports the slip, wherein the reducing further comprises displacing the mandrel and the support surface in a second direction opposite to the first direction, and wherein the displacing the mandrel and the support surface in the second direction further comprises a gripping device preventing displacement of the mandrel in the second direction relative to the support surface.

2. The method of claim 1, wherein the displacing the mandrel in the first direction further comprises the gripping device permitting the displacement of the mandrel relative to the support surface.

3. A retrievable well packer, comprising:

a generally tubular mandrel;

at least one slip configured for gripping a well surface, wherein the slip extends outward by engagement with a support surface during setting of the retrievable packer; and a gripping device which permits displacement of the mandrel relative to the support surface in a first direction, and which prevents displacement of the mandrel relative to the support surface in a second direction opposite to the first direction, wherein the slip retracts inwardly in response to displacement of the mandrel and the support surface in the second direction during unsetting of the retrievable packer.

4. The well packer of claim 3, wherein the gripping device comprises a resilient toothed sleeve which grips the mandrel.

5. The well packer of claim 3, wherein the gripping device is connected to the support surface.

6. The well packer of claim 3, wherein the support surface comprises a frusto-conical surface which engages an inclined surface of the slip.

7. The well packer of claim 3, wherein the gripping device comprises inner teeth which in an operative position thereof operatively engage the mandrel, the inner teeth conforming substantially to a pitch diameter of the inner teeth at the operative position.

8. The well packer of claim 7, wherein the gripping device resiliently grips the mandrel when the inner teeth are at the operative position.

* * * * *